US007299827B1

(12) United States Patent
Minamitani et al.

(10) Patent No.: US 7,299,827 B1
(45) Date of Patent: Nov. 27, 2007

(54) LOOM RESTARTING METHOD

(75) Inventors: Norio Minamitani, Kanazawa (JP); Masato Matsumoto, Kanazawa (JP); Hirohisa Kitamura, Kanazawa (JP); Kiyoshi Arie, Kanazawa (JP)

(73) Assignee: Tsudakoma Kogyo Kabushiki Kaisha, Ishikawa-ken (JP)

( * ) Notice: Subject to any disclaimer, the term of this patent is extended or adjusted under 35 U.S.C. 154(b) by 0 days.

(21) Appl. No.: 09/292,386

(22) Filed: Apr. 15, 1999

(30) Foreign Application Priority Data

Apr. 17, 1998 (JP) ..... 10-124130

(51) Int. Cl.
*D03D 51/08* (2006.01)
*D03D 51/34* (2006.01)
*D03D 49/50* (2006.01)

(52) U.S. Cl. ..... 139/116.2; 139/1 E; 139/1 F; 139/336; 139/370.1; 139/370.2

(58) Field of Classification Search ..... 139/116.2, 139/1 E, 1 F, 450–453, 190, 192, 336, 370.1, 139/370.2
See application file for complete search history.

(56) References Cited

U.S. PATENT DOCUMENTS 3,805,850 A * 4/1974 Van Duynhoven et al. . 139/1 E
4,185,667 A * 1/1980 Kendrick ..... 139/302
4,570,681 A 2/1986 Wada
4,635,686 A * 1/1987 Terasaki ..... 139/116.2
4,688,606 A * 8/1987 Tamatani ..... 139/116.2
4,730,643 A * 3/1988 Tamatani ..... 139/116.2
4,749,006 A * 6/1988 Miyamoto ..... 139/116.2
4,805,670 A * 2/1989 Shaw ..... 139/353
4,838,319 A * 6/1989 Suwa ..... 139/116.1
4,890,649 A * 1/1990 Takahashi ..... 139/116.2
4,890,650 A * 1/1990 Mitsuya ..... 139/116.2
4,898,214 A * 2/1990 Lewyllie et al. ..... 139/116.2
4,899,788 A * 2/1990 Aarts ..... 139/116.2

(Continued)

FOREIGN PATENT DOCUMENTS

EP 0 094 089 11/1983

(Continued)

*Primary Examiner*—Gary L. Welch
*Assistant Examiner*—Robert H Muromoto, Jr.
(74) *Attorney, Agent, or Firm*—Wenderoth, Lind & Ponack, L.L.P.

(57) ABSTRACT

A loom restarting method restarts a loom stopped due to a loom stopping cause without entailing a "wavy set mark". When a loom is stopped due to a loom stopping cause entailing faulty picking, the loom restarting method provides a loom stopping command, withholds the loom from a picking operation during a braking period for braking the loom to stop the same in a weaving cycle subsequent to a weaving cycle in which the loom stopping cause occurred, reverses the loom to the weaving cycle in which faulty picking occurred, removes a weft yarn picked by faulty picking, and restarts the loom to resume a normal weaving operation. The main shaft of the loom is positioned, after removing the weft yarn picked by faulty picking, at an angular position at which a picking operation is possible in the weaving cycle in which the weft yarn picked by faulty picking was removed and the reed of the loom is not in contact with a weft yarn inserted in the cloth fell of a fabric on the loom, and then the loom is restarted.

4 Claims, 9 Drawing Sheets

Loom stopping cause entailing faulty picking

U.S. PATENT DOCUMENTS

| | | | | | |
|---|---|---|---|---|---|
| 4,967,803 | A | * | 11/1990 | Pajgrt et al. | 139/116.2 |
| 4,967,807 | A | * | 11/1990 | Lewyllie et al. | 139/452 |
| 4,989,644 | A | * | 2/1991 | Tanaka et al. | 139/116.2 |
| 4,998,567 | A | * | 3/1991 | Shaw | 139/116.2 |
| 5,012,844 | A | * | 5/1991 | Griffith | 139/452 |
| 5,016,676 | A | * | 5/1991 | Fourneaux et al. | 139/116.2 |
| 5,129,430 | A | * | 7/1992 | Mitsuya | 139/116.2 |
| 5,161,582 | A | * | 11/1992 | Wakamatsu | 139/116.2 |
| 5,224,520 | A | * | 7/1993 | Shinbara et al. | 139/116.2 |
| 5,246,037 | A | * | 9/1993 | Degen et al. | 139/116.2 |
| 5,332,007 | A | * | 7/1994 | Wahhoud | 139/116.2 |
| 5,335,698 | A | * | 8/1994 | Berktold et al. | 139/116.2 |
| 5,386,855 | A | * | 2/1995 | Corain et al. | 139/99 |
| 5,388,618 | A | * | 2/1995 | Decock | 139/1 R |
| 5,406,986 | A | * | 4/1995 | Oda et al. | 139/116.2 |
| 5,487,413 | A | * | 1/1996 | Hatakeyama et al. | 139/116.2 |
| 6,575,201 | B2 | * | 6/2003 | Buesgen | 139/387 R |
| 6,997,215 | B2 | * | 2/2006 | Buhlmann | 139/452 |

FOREIGN PATENT DOCUMENTS

| | | |
|---|---|---|
| EP | 0 445 687 | 9/1991 |
| GB | 2 090 620 | 7/1982 |
| JP | 4-281047 | 10/1992 |

* cited by examiner

Loom stopping cause entailing faulty picking

Loom stopping cause other than faulty picking

Faulty picking (One-shot-starting method)

Loom stopping cause entailing faulty picking

Loom stopping cause other than faulty picking

LOOM RESTARTING METHOD

BACKGROUND OF THE INVENTION

1. Field of the Invention

The present invention relates to a method of restarting a loom which is stopped upon the occurrence of faulty picking or a loom stopping cause that requires stopping the loom.

2. Description of the Related Art

FIGS. 1 and 2 are diagrams of weaving cycles A, B and C in which conventional procedures of stopping a loom upon the occurrence of a loom stopping cause requiring stopping the loom, removing the loom stopping cause and restarting the loom, in relation with the angular position of the main shaft of the loom. FIG. 1 shows a procedure of stopping and restarting the loom when the loom is stopped due to faulty picking, and FIG. 2 shows a procedure of stopping and restarting the loom when the loom is stopped due to a loom stopping cause other than faulty picking.

Referring to FIGS. 1 and 2, a picking operation is carried out at an angular position of about 80° in the weaving cycle A, and a beating-up operation is completed at an angular position of 360° corresponding to an angular position of 0° in the weaving cycle B. When a fault is detected in the weaving cycle B and a stop signal is provided at an angular position of, for example, 290°, generally, the loom keeps operating for a braking period corresponding to about one turn of the main shaft, and the loom comes to an initial stop with the main shaft at an angular position of, for example, 260° in the weaving cycle C. Any picking operation is not carried out in the weaving cycle C subsequent to the weaving cycle B in which the loom stopping cause was detected. A shedding operation, a beating-up operation, a let-off operation and a take-up operation are carried out while the loom is being braked to stop the same.

Referring to FIG. 1, when a weft yarn is picked by faulty picking, a loom controller, not shown, reverses the loom at a low speed, stops the loom for an intermediate stop at an angular position of, for example, 180° in the weaving cycle B in which faulty picking occurred to remove a weft yarn picked by faulty picking. In this state, the weft yarn picked by faulty picking is removed by an operator or by an automatic weft extracting device. Subsequently, the loom is further reversed at a low speed and is stopped for a final stop at an angular position of, for example, 310° in the weaving cycle A preceding the weaving cycle B, and then the loom is restarted. When warp yarns need mending, the warp yarns are mended while the loom is at any one of the stops.

Referring to FIG. 2, if the loom is stopped in spite of successful picking, the intermediate stop is skipped, and the loom is reversed and stopped for the final stop at an angular position of, for example, 310° in the weaving cycle B preceding the weaving cycle C in which the loom was stopped for the initial stop, and then the loom is restarted. If the warp yarn needs mending, the warp yarns are mended at any one of the stops.

When the loom is reversed at a low speed in a period in which the weaving operations of the loom are stopped, the cloth fell of a fabric on the loom is beaten by a false beating-up operation and several weft yarns adjacent to the cloth fell are dislocated in the direction of the thickness of the fabric. As is generally known, a thick filling streak, i.e., a pillowlike protrusion extending across the fabric generally called "wavy set mark", is liable to be formed if the loom is restarted with the weft yarns adjacent to the cloth fell dislocated in the direction of the thickness of the fabric. A false beating-up operation is repeated three times as shown in FIG. 1 when faulty picking occurs. A false beating-up operation is repeated twice as shown in FIG. 2 when the loom is not stopped due to faulty picking. The repetition of the false beating-up operation causes the defect called "wavy set mark".

There is a known loom restarting method called "one-shot-picking" method as a means for preventing the defect called "wavy set mark". As shown in FIG. 3, the one-shot picking method inserts one weft yarn after removing the weft yarn picked by faulty picking when the loom is at the position for the intermediate stop (FIG. 1), and then restarts the loom. Therefore, two false beating-up operations can be omitted, so that the formation of the defect called "wavy set mark" can be prevented.

However, when the loom is restarted by the one-shot-picking method, the weft yarn inserted into the shed at the restart of the loom cannot be beaten up properly because the main shaft is at an angular position of, for example, 180° where the warp is substantially in a maximum shed for picking, the rotating speed of the main shaft of the loom is unable to rise to a normal operating speed before the first beating-up operation after restarting and, consequently, a light filling bar is formed. Furthermore, the one-shot-picking method cannot be applied to restarting the loom when the loom is stopped due to a cause other than faulty picking.

SUMMARY OF THE INVENTION

Accordingly, it is an object of the present invention to prevent the formation of a thick filling streak called "wavy set mark" when restarting a loom stopped by a stopping cause.

According to a first aspect of the present invention, a loom restarting method comprises the steps of: providing a loom stopping command upon the occurrence of a loom stopping cause entailing faulty picking in a loom; withholding the loom from a picking operation during a braking period to stop the loom in a weaving cycle subsequent to a weaving cycle in which faulty picking occurred; reversing the loom to the weaving cycle in which faulty picking occurred; removing a weft yarn picked by faulty picking; and restarting the loom for a normal weaving operation; wherein the main shaft of the loom is positioned, after removing the weft yarn picked by faulty picking, at an angular position at which a picking operation is possible in the weaving cycle in which the weft yarn picked by faulty picking was removed and a reed included in the loom is not in contact with a weft yarn inserted in the cloth fell of a fabric on the loom, and then the loom is restarted.

According to a second aspect of the present invention, a loom restarting method comprises the steps of: providing a loom stopping command upon the occurrence of a loom stopping cause other than faulty picking in a loom; withholding the loom from a picking operation during a braking period to stop the loom for an initial stop in a weaving cycle subsequent to a weaving cycle in which the loom stopping cause occurred; removing the loom stopping cause; and restarting the loom for a normal weaving operation; wherein the main shaft of the loom is positioned at an angular position at which a picking operation is possible in the weaving cycle in which the loom was stopped for the initial stop and a reed included in the loom is not in contact with a weft yarn inserted in the cloth fell of a fabric on the loom, and then the loom is restarted.

According to a third aspect of the present invention, a loom restarting method comprises the steps of: providing a loom stopping command upon the occurrence of a loom stopping cause in a loom; withholding the loom from a picking operation during a braking period to stop the loom for an initial stop in a weaving cycle subsequent to a weaving cycle in which the loom stopping cause occurred; removing the loom stopping cause; and restarting the loom for a normal weaving operation; wherein a decision is made as to whether or not the loom stopping cause entails faulty picking before the loom is stopped for the initial stop; the loom is reversed to a weaving cycle in which faulty picking occurred, a weft yarn picked by faulty picking is removed, and the main shaft of the loom is positioned at an angular position at which a picking operation is possible in the weaving cycle in which faulty picking occurred and a reed included in the loom is not in contact with a weft yarn inserted in the cloth fell of a fabric on the loom, and then the loom is restarted if the loom stopping cause entails faulty picking, or the loom stopping cause is removed, the main shaft of the loom is positioned at an angular position at which a picking operation is possible in the weaving cycle in which faulty picking occurred and the reed of the loom is not in contact with a weft yarn inserted in the cloth fell of the fabric on the loom, and then the loom is restarted if the loom stopping cause does not entail faulty picking.

According to a fourth aspect of the present invention, a loom restarting method comprises the steps of: providing a loom stopping command upon the occurrence of a loom stopping cause in a loom; withholding the loom from a picking operation during a braking period to stop the loom for an initial stop in a weaving cycle subsequent to a weaving cycle in which the loom stopping cause occurred; removing the loom stopping cause; and restarting the loom for a normal weaving operation; wherein a decision is made as to whether or not the loom stopping cause entails faulty picking before the loom is stopped for the initial stop; and the loom is restarted either after reversing the loom to a weaving cycle in which faulty picking occurred, removing a weft yarn picked by faulty picking, and carrying out a picking operation, or after removing the weft yarn picked by faulty picking, and positioning a main shaft included in the loom at an angular position at which a picking operation is possible in the weaving cycle in which faulty picking occurred and the reed of the loom is not in contact with a weft yarn inserted in the cloth fell of a fabric on the loom, depending on weaving conditions if the loom stopping cause entails faulty picking, or the loom is restarted after removing the loom stopping cause, and positioning the main shaft of the loom at an angular position at which a picking operation is possible in the weaving cycle in which the loom was stopped for the initial stop and the reed of the loom is not in contact with a weft yarn inserted in the cloth fell of the fabric on the loom if the loom stopping cause does not entail faulty picking.

According to the present invention, the number of false beating-up operations can be reduced in a process between the stop of the loom and the restart of the same and several picked weft yarns adjacent to the cloth fell of the fabric will scarcely be dislocated in the direction of the thickness of the fabric. Thus, the defect called "wavy set mark" is prevented and the quality of the fabric can be improved.

According to the first and the second aspect of the present invention, since a picking operation is possible in the weaving cycle in which the weft yarn picked by faulty picking is removed or in the weaving cycle in which the loom is stopped for the initial stop, and with the main shaft of the loom positioned at the angular position at which the reed is not in contact with the weft yarn in the cloth fell, a picking operation can be achieved without trouble after the loom has been restarted.

According to the third and the fourth aspect of the present invention, a decision is made as to whether or not the loom stopping cause includes faulty picking, and the loom is restarted from the weaving cycle in which the weft yarn picked by faulty picking is removed or the weaving cycle in which the loom is stopped for the initial stop depending on a decision as to whether or not the loom stopping cause includes faulty picking. Thus, the loom can be restarted from an appropriate weaving cycle.

According to the fourth aspect of the present invention, an angular position of the main shaft of the loom is determined according to the decision as to whether or not the loom stopping cause includes faulty picking and the weaving conditions. Therefore an appropriate angular position for the main shaft of the loom can be determined.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
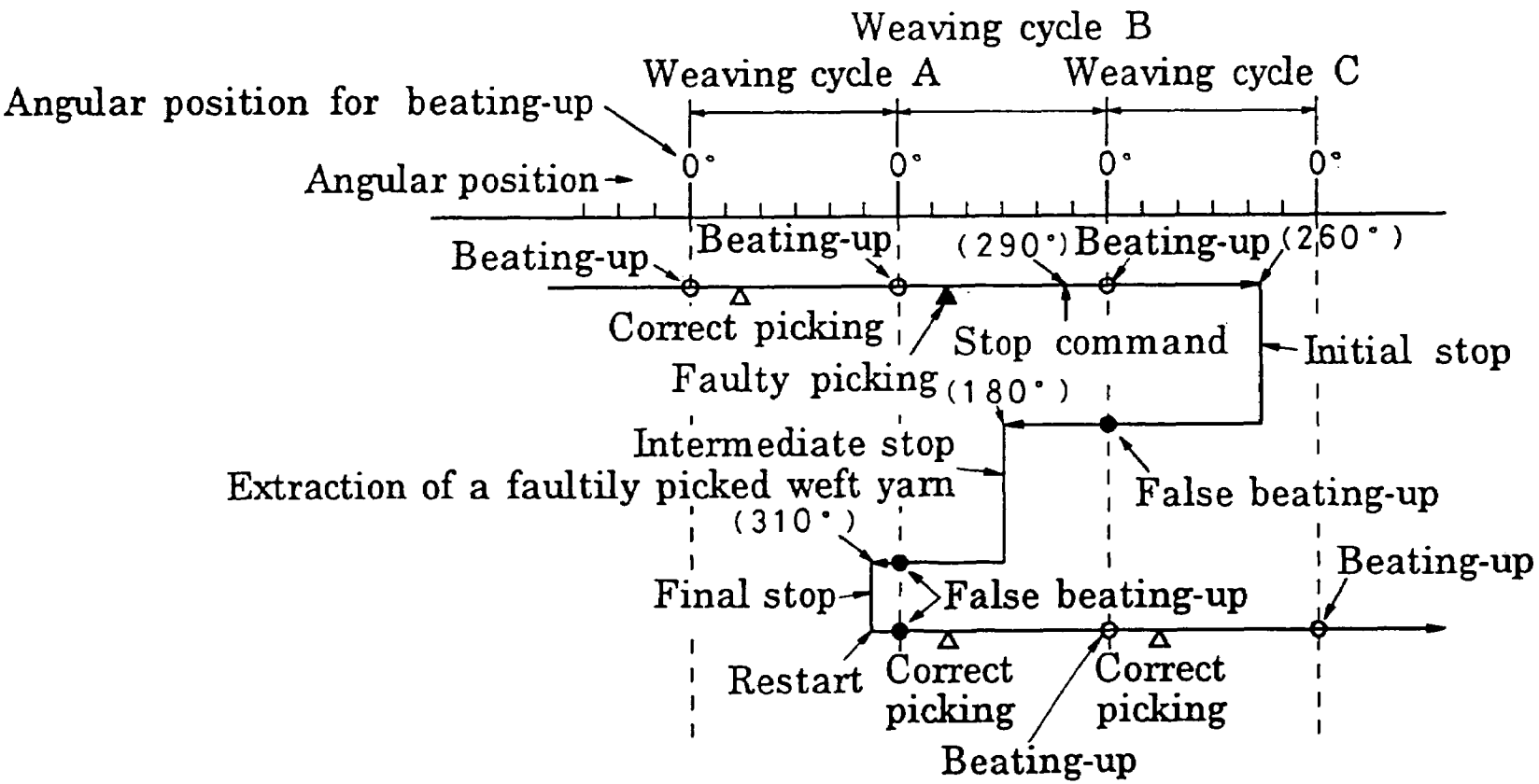
FIG. 1 is a diagram of assistance in explaining a conventional loom restarting method by which a loom is restarted after being stopped due to faulty picking.
Figure 2:
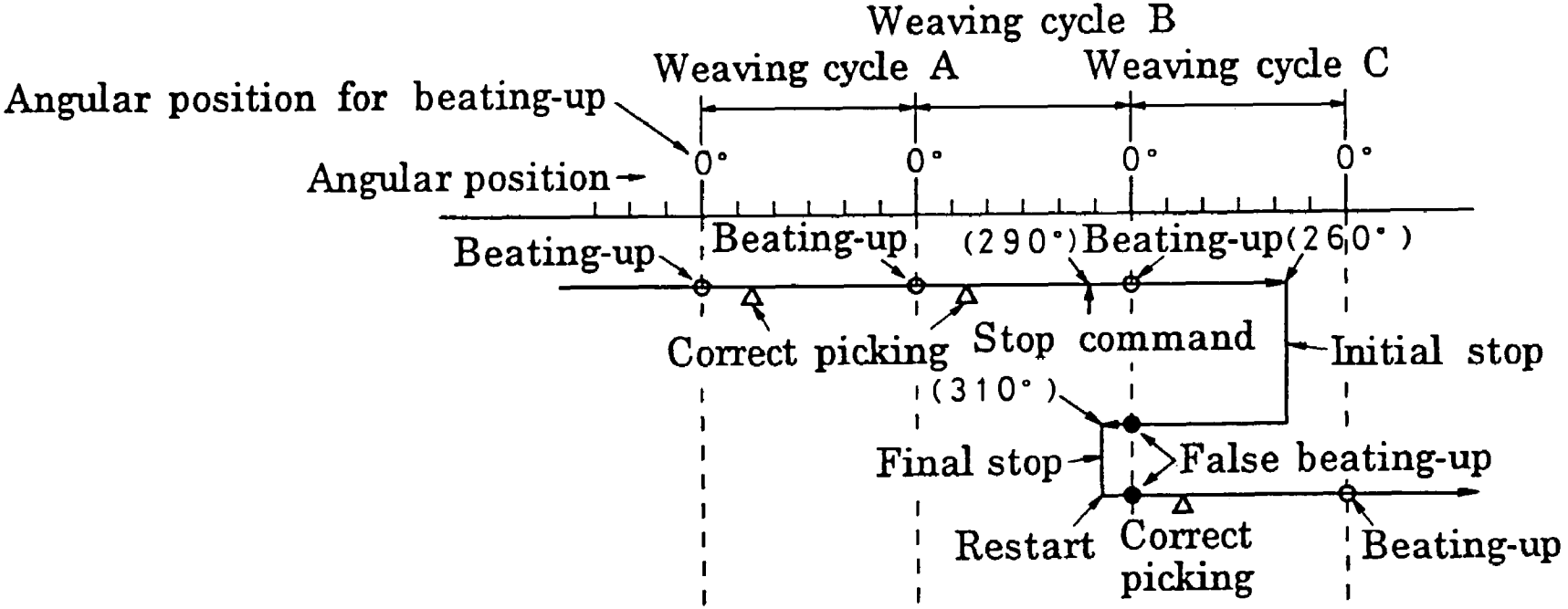
FIG. 2 is a diagram of assistance in explaining a conventional loom restarting method by which a loom is restarted after being stopped due to a loom stopping cause other than faulty picking.
Figure 3:
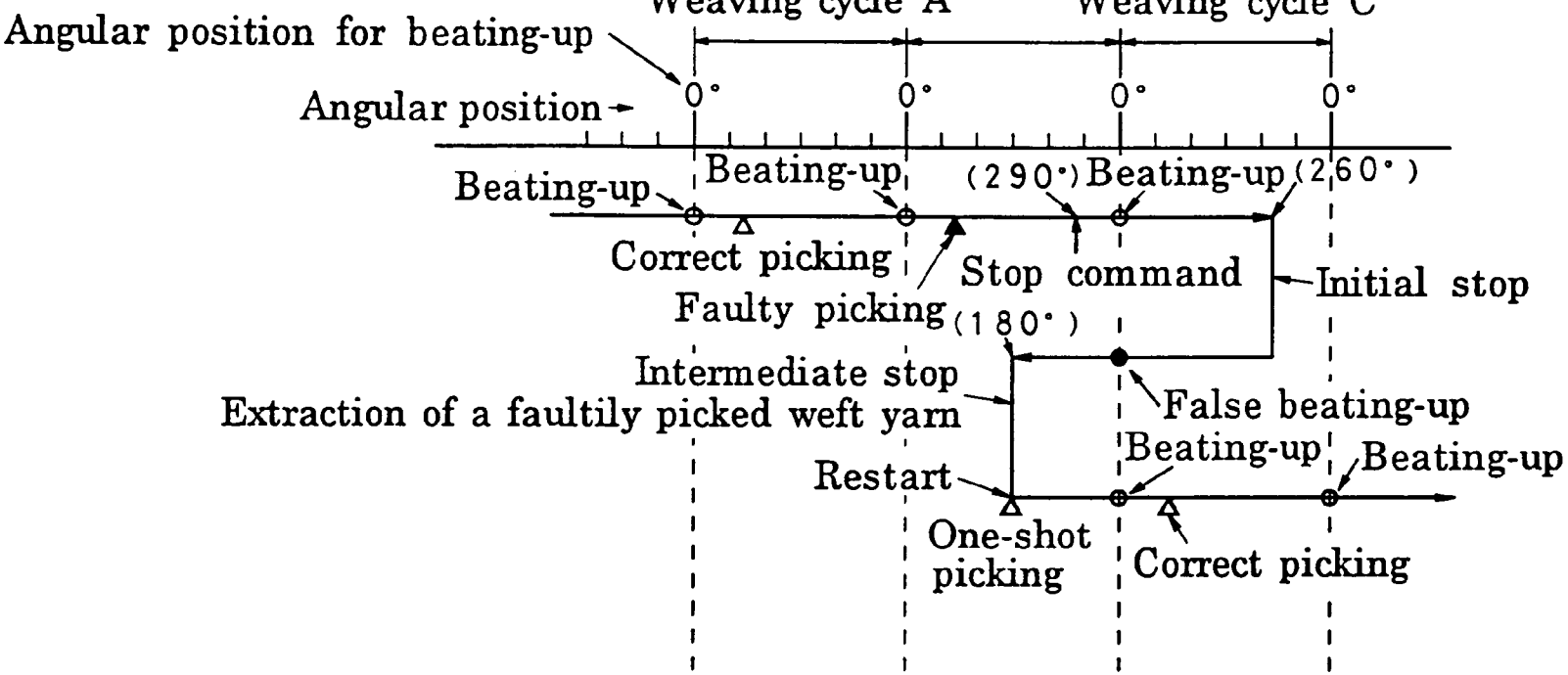
FIG. 3 is a diagram of assistance in explaining a conventional one-shot-picking method by which a loom is restarted after being stopped due to faulty picking.
Figure 4:
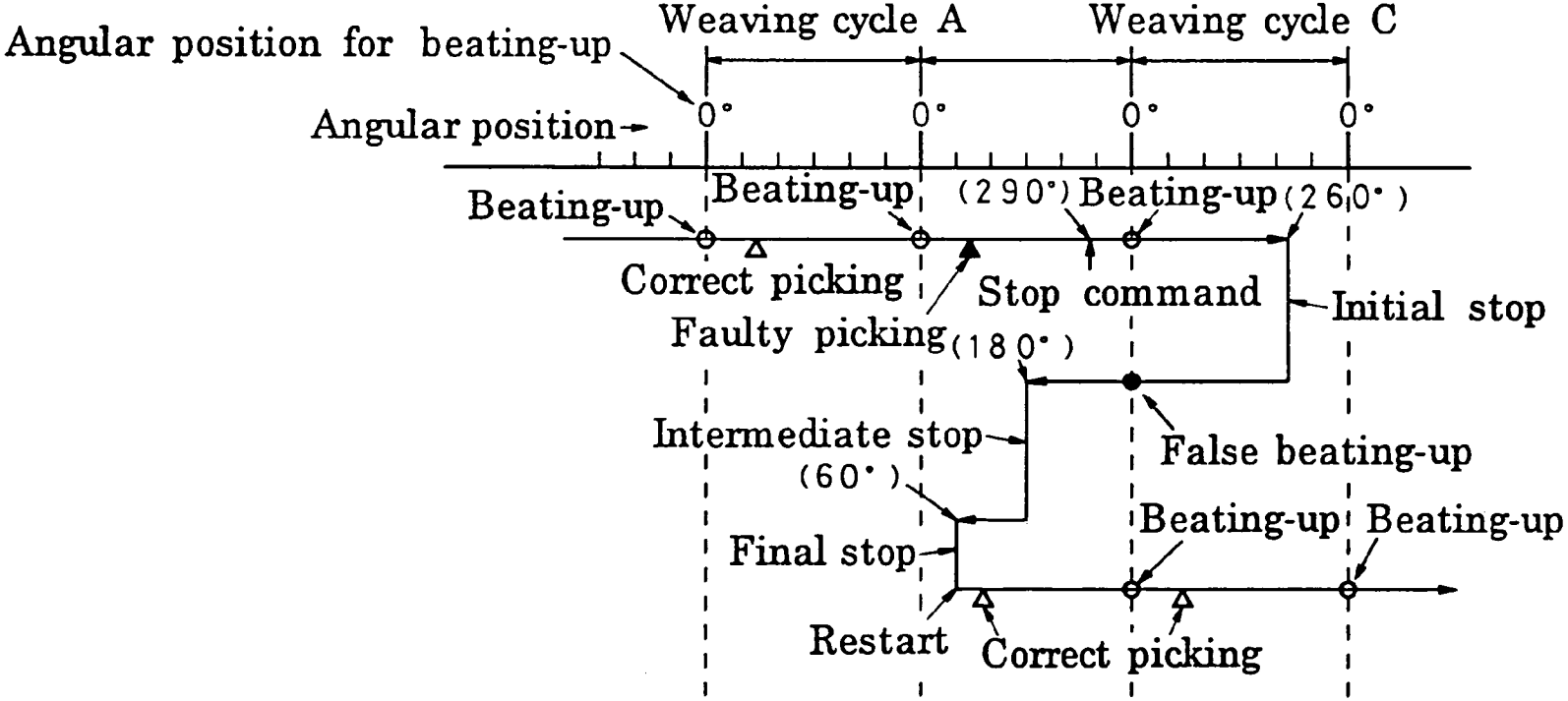
FIG. 4 is a diagram of assistance in explaining a loom restarting method according to the present invention by which a loom is restarted after being stopped due to faulty picking.
Figure 5:
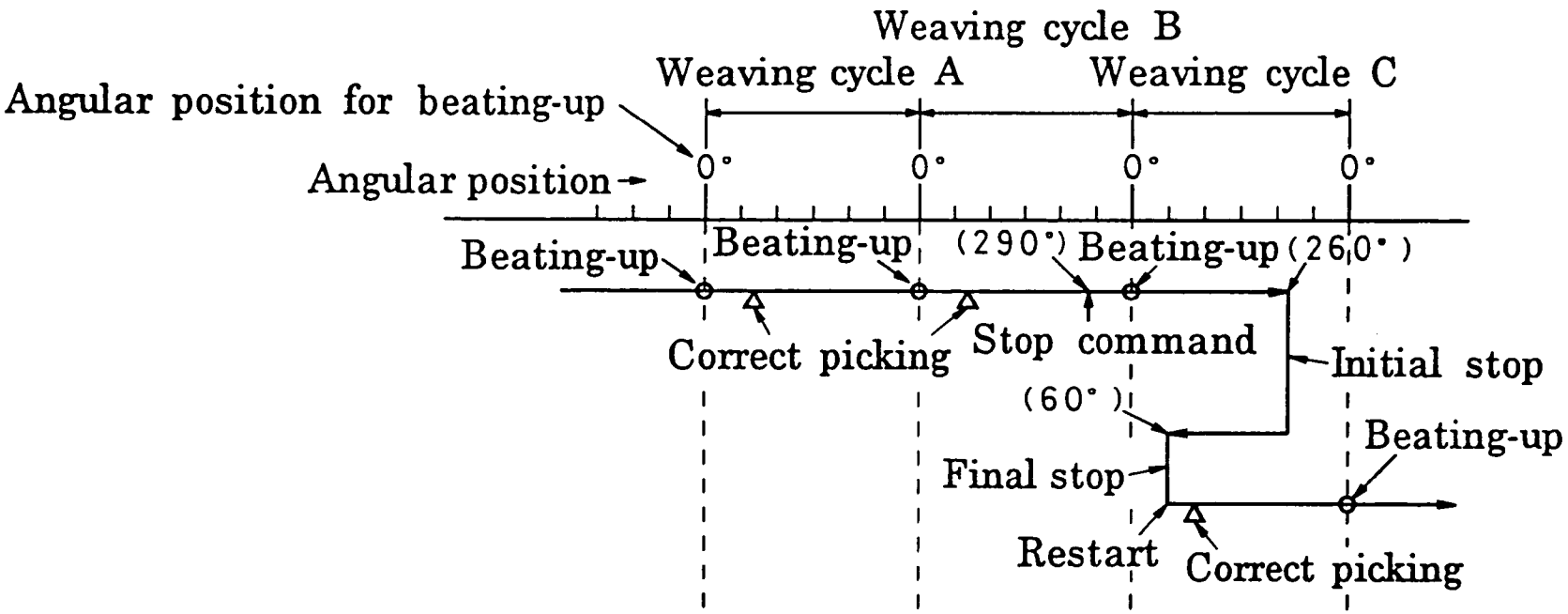
FIG. 5 is a diagram of assistance in explaining a loom restarting method according to the present invention by which a loom is restarted after being stopped due to a loom stopping cause other than faulty picking.

A loom restarting method in a first embodiment according to the present invention will be described with reference to FIGS. 4 and 5. FIG. 4 shows a procedure to be carried out by the loom restarting method when a loom is stopped due to faulty picking. FIG. 5 shows a procedure to be carried out by the loom restarting method when a loom is stopped due to a loom stopping cause other than faulty picking. Steps of the procedure shown in FIG. 4 from an initial stop to an intermediate stop are the same as those of the procedure of the conventional loom restarting method previously described with reference to FIG. 1. Steps of the procedure shown in FIG. 5 to an initial stop are the same as those of the procedure of the conventional loom restarting method previously described with reference to FIG. 2.

Referring to FIG. 4, when a faulty picking occurs in a loom in a weaving cycle B, the loom is stopped for an initial stop in a weaving cycle C subsequent to the weaving cycle B, the loom is reversed at a low speed to an angular position for an intermediate stop, a weft yarn picked by faulty picking is removed during the intermediate stop by an operator or an automatic weft extracting device, the loom is reversed at a low speed to an angular position of, for example, 60° in the weaving cycle B for a final stop, and then the loom is restarted. Then, a picking operation is executed in the weaving cycle B and the weaving operation of the loom is resumed. This loom restarting method will be called "60°-starting method" in the following description.

When the loom is restarted by the 60'-starting method, the first weft yarn picked after the restart of the loom can properly be beaten up, and the loom is stopped for both the intermediate and final stop in the same weaving cycle B. Therefore, the number of false picking operations is less by two than that of false picking operations necessary when the loom is restarted by the foregoing conventional loom restarting method. Accordingly, several weft yarns adjacent to the cloth fell of a fabric on the loom are scarcely dislocated in the direction of the thickness of the fabric and hence the formation of a defect called "wavy set mark" can be prevented.

The 60°-starting method exercises the same effect in restarting the loom stopped due to a loom stopping cause other than faulty picking. Referring to FIG. 5, when a loom stopping cause other than faulty picking occurs in a weaving cycle B, the loom is stopped in the weaving cycle C for an initial stop, the loom is reversed at a low speed to an angular position of, for example, 60° in the weaving cycle C, and then the loom is restarted. The first picking operation after the restart of the loom is executed in the weaving cycle C and the weaving operation of the loom is resumed.

The angular position of 60° at which the loom is restarted by the 60°-starting method is an optimum angular position selectively determined on the basis of data acquired through the experimental operation of the loom. The angular position for restarting the loom is not limited to 60° and may be any angular position provided that the first picking operation after the restart of the loom can be achieved in the weaving cycle in which the loom is restarted and the reed of the loom does not come into contact with a weft yarn inserted in the cloth fell of a fabric on the loom in the weaving cycle in which the loom is restarted.

It is desirable that the loom is restarted with the main shaft at an angular position smaller than 70° to secure a sufficient picking period and to beat up properly a weft yarn picked by the first picking operation after the restart of the loom.

Several picked weft yarns adjacent to the cloth fell are loose and are not woven exactly in the fabric. Therefore, those weft yarns are dislocated slightly from a beating-up position toward the let-off motion of the loom and hence it is possible that the reed comes into contact with those weft yarns adjacent to the cloth fell when the main shaft of the loom is at an angular position in the range of 30° to 40°.

When mending warp yarns before restarting the loom, particularly when piecing together warp yarns near temples disposed near the opposite ends of the cloth fell, it is necessary that the reed is spaced a sufficient distance apart from the cloth fell toward the let-off motion to provide a sufficient space for warp yarn piecing work between the reed and the cloth fell. Therefore, the angular position of the main shaft for restarting the loom must be greater than 40°. Accordingly, an appropriate angular position of the main shaft at the restart of the loom is in the range of 40° to 70°.

Figure 6:
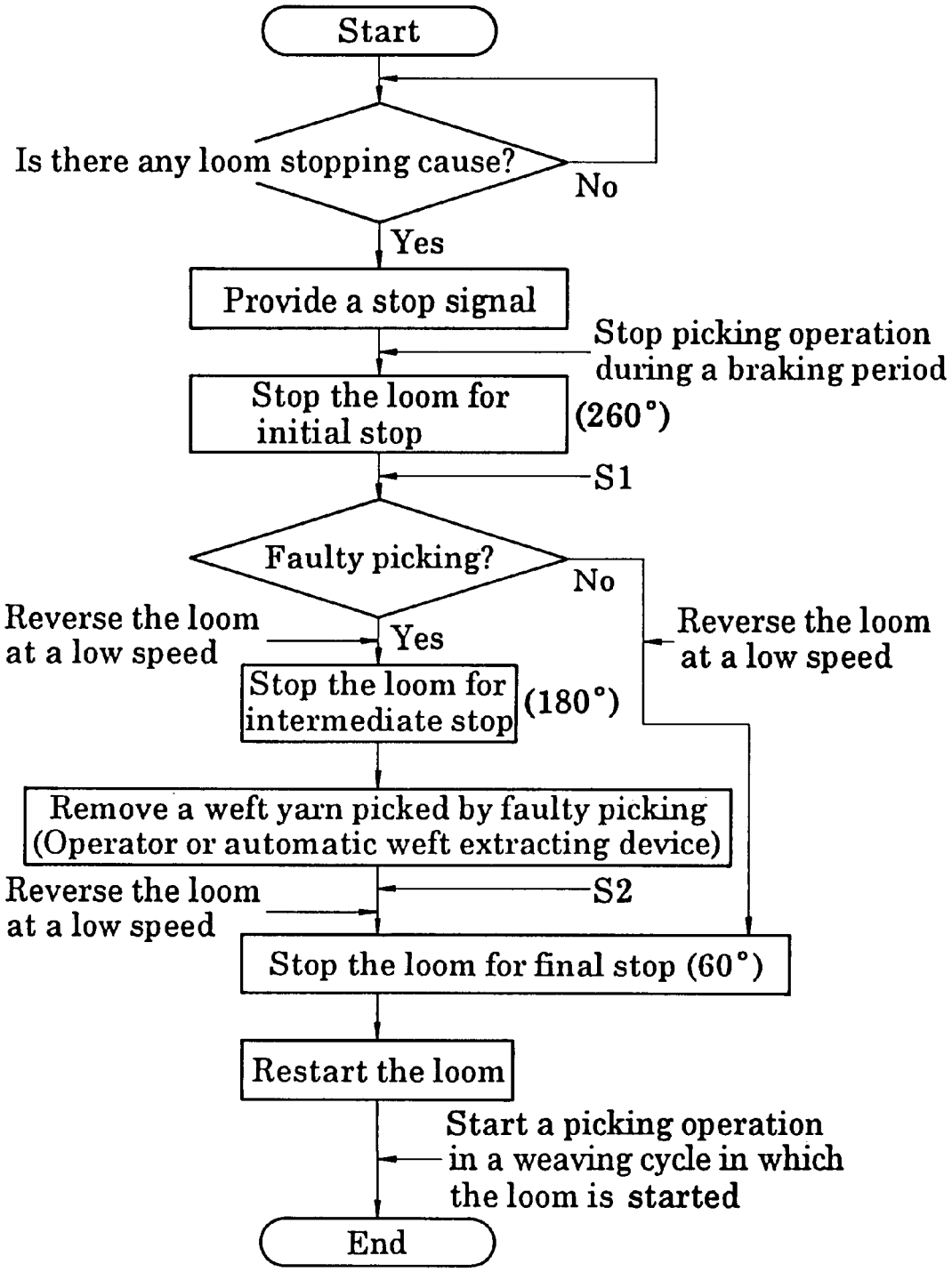
FIG. 6 is a flow chart of a control program to be carried out by a loom restarting method according to the present invention.

The 60'-starting method need not be applied exclusively only to restarting the loom when the loom is stopped due to faulty picking or to restarting the loom when the loom is stopped due to a loom stopping cause other than faulty picking. As shown in FIG. 6, a decision may be made as to whether or not faulty picking occurred after the loom has been stopped, and either a procedure of restarting the loom when the loom is stopped due to faulty picking or a procedure of restarting the loom when the loom is stopped due to a loom stopping cause other than faulty picking may be carried out depending on the cause of stopping of the loom. The suitable procedure may manually or automatically selected. When necessary, the warp yarns may be mended while the loom is in any one of the initial, the intermediate and the final stop. Generally, a start button is operated by an operator to start the loom. The start button is operated when providing a start button signal S1 after the initial stop and when providing a start button signal S2 after removing the weft yarn picked by faulty picking while the loom is in the intermediate stop (or in the final stop) as shown in FIG. 6. If the weft yarn picked by faulty picking is removed by an operator, the start button is operated to provide the start button signal S2 after removing the weft yarn picked by faulty picking. If the weft yarn picked by faulty picking is removed by an automatic weft extracting device, the start button is operated to provide the start button signal S1 after the loom has been stopped for the initial stop, and the following steps including a loom restarting step may be carried out automatically, which will prevent troubles resulting from wrong manual operations. If the loom stopping cause is only faulty picking and the weft yarn picked by faulty picking can be removed by the automatic weft extracting device, all the steps of the procedure may be automated and the operation of the start button may be omitted. If the automatic weft extracting device fails in removing the weft yarn picked by faulty picking, the same weft yarn may be removed by an operator, and the start button is operated by an operator to provide the start button signal S2.

A loom restarting method in a second embodiment according to the present invention will be described hereinafter. First, the effect of the use of both the 60'-starting method and the one-shot-picking method in combination will be described. As mentioned above, false picking operations while the weaving operation is stopped cause the defect called "wavy set mark". It is known that the reverse operation of the loom at a low speed while the weaving operation is stopped also causes the defect called "wavy set mark". As mentioned above, when the loom is restarted by the one-shot-picking method, the first weft yarn picked after the restart of the loom can not properly be beaten up. However, when loom is restarted by the one-shot-picking method, the number of false picking operations is less by two than that of false picking operations necessary when the loom is restarted by the conventional loom restarting method and one reversing operation can be omitted. These effects of the one-shot-picking method prevents the formation of the defect called "wavy set mark". Therefore, it is preferable to restart the loom by the one-shot-picking method when the loom is operating under weaving conditions not requiring heavy beating-up, such as those for weaving a coarse fabric. Accordingly, the formation of the defect called "wavy set mark" can further effectively be prevented if the one-shot-picking method or the 60'-starting method is used selectively depending on weaving conditions.

Figure 7:
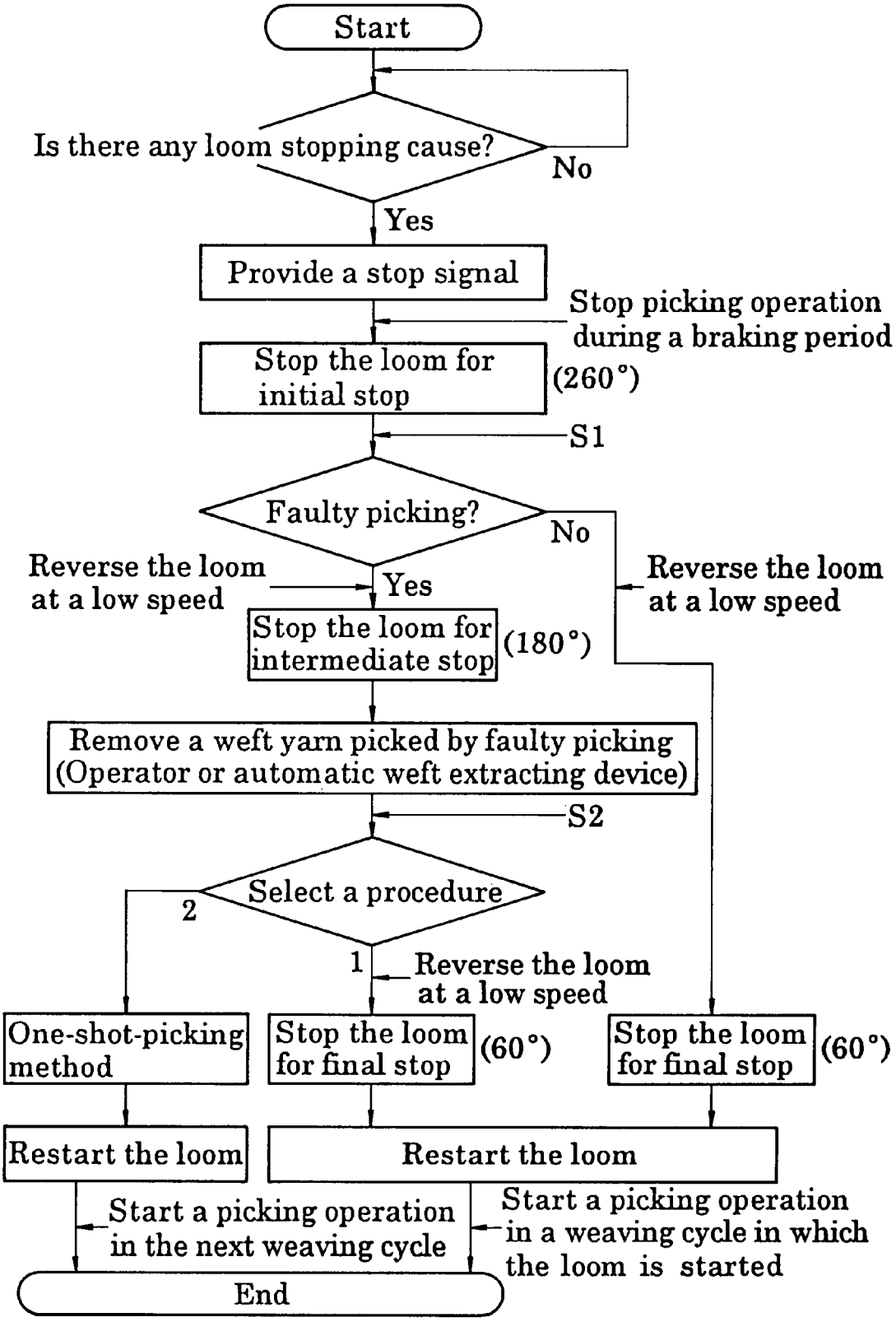
FIG. 7 is a flow chart of a control program to be carried out by a loom restarting method according to the present invention.

FIG. 7 is a flow chart of a control program to use the one-shot-picking method or the 60'-starting method selectively depending on weaving conditions. The selection of either the one-shot-picking method or the 60°-starting method is necessary only when the loom is stopped due to faulty picking. If the loom is stopped by a loom stopping cause other than faulty picking, the same procedure as that shown in FIG. 6 is carried out. As mentioned in connection with FIG. 6, the loom may be restarted automatically without requiring the operation of the start button (FIG. 6) or may be restarted by operating the start button to provide the start button signal S1 or the start button S2 (FIG. 7) if the loom is stopped by faulty picking and the weft yarn picked by faulty picking can be removed by the automatic weft extracting device.

The first picking operation after the weaving operation has been resumed is executed in a weaving cycle in which the weaving operation is resumed when the loom is restarted by the 60'-starting method. The first picking operation after the weaving operation has been resumed is executed in a weaving cycle subsequent to a weaving cycle in which the weaving operation is resumed when the loom is restarted by the one-shot-picking method. Since the speed of the slay of the loom in the weaving cycle in which the weaving operation is resumed and that of the same in the weaving cycle next to that in which the weaving operation is resumed are different, it is desirable to set specific picking conditions including the angular position of the main shaft for operating the yarn holding pin of a weft yarn measuring and storing device, the angular position of the main shaft for starting the jetting operation of a picking nozzle and the angular position of the main shaft for stopping the jetting operation of the picking nozzle for each of the 60'-starting method and the one-shot-starting method.

Figure 8:
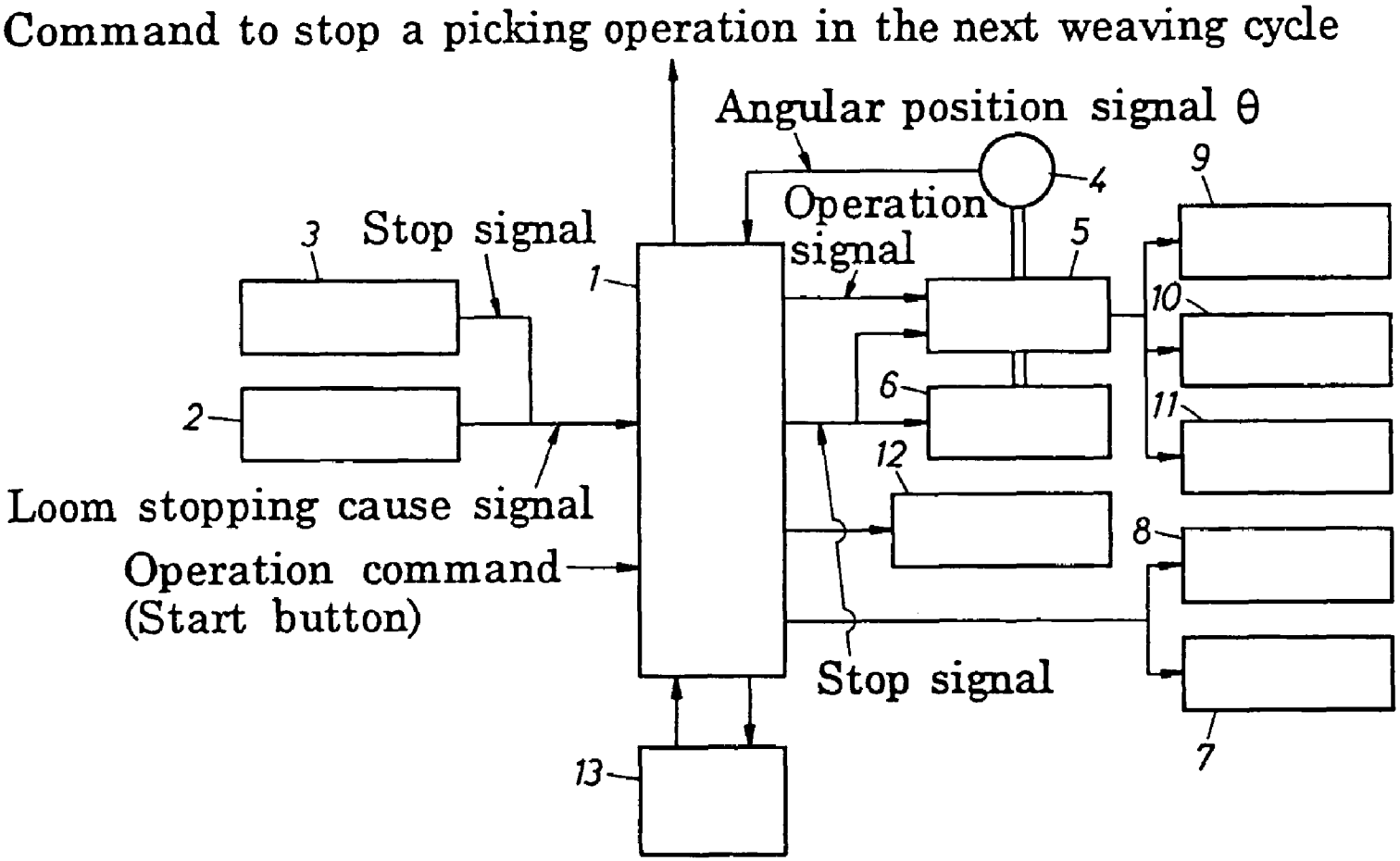
FIG. 8 is a block diagram of a control system for carrying out a loom restarting method according to the present invention.

FIG. 8 shows a control system for carrying out the 60°-starting method. A stop command, such as a stop signal provided by operating a stop button 3 or a loom stopping cause detection signal provided by a loom stopping cause detector 2, is given to a controller 1. The controller 1 finds the angular position of the main shaft from an angular position signal 0 provided by an encoder 4, gives a stop signal to a main motor 5 and a main shaft braking device 6, and gives a stop command to a picking motion 7 and a let-off motion 8 to stop picking a weft yarn in the next weaving cycle and to stop the let-off operation of the let-off motion 8. A shedding motion 9, a beating-up motion 10 and a take-up motion 11 perform a shedding operation, a beating-up operation and a take-up operation, respectively, in synchronism with the operation of the main motor 5. If the loom stopping cause detection signal indicates faulty picking, the controller 1 gives an operation command to an automatic weft extracting device 12 to extract a weft yarn picked by faulty picking from the shed. The controller 1 controls all or some of the steps of the procedure to be carried out after the stop of the loom to restart the loom according to information stored in a storage device 13.

Figure 9:
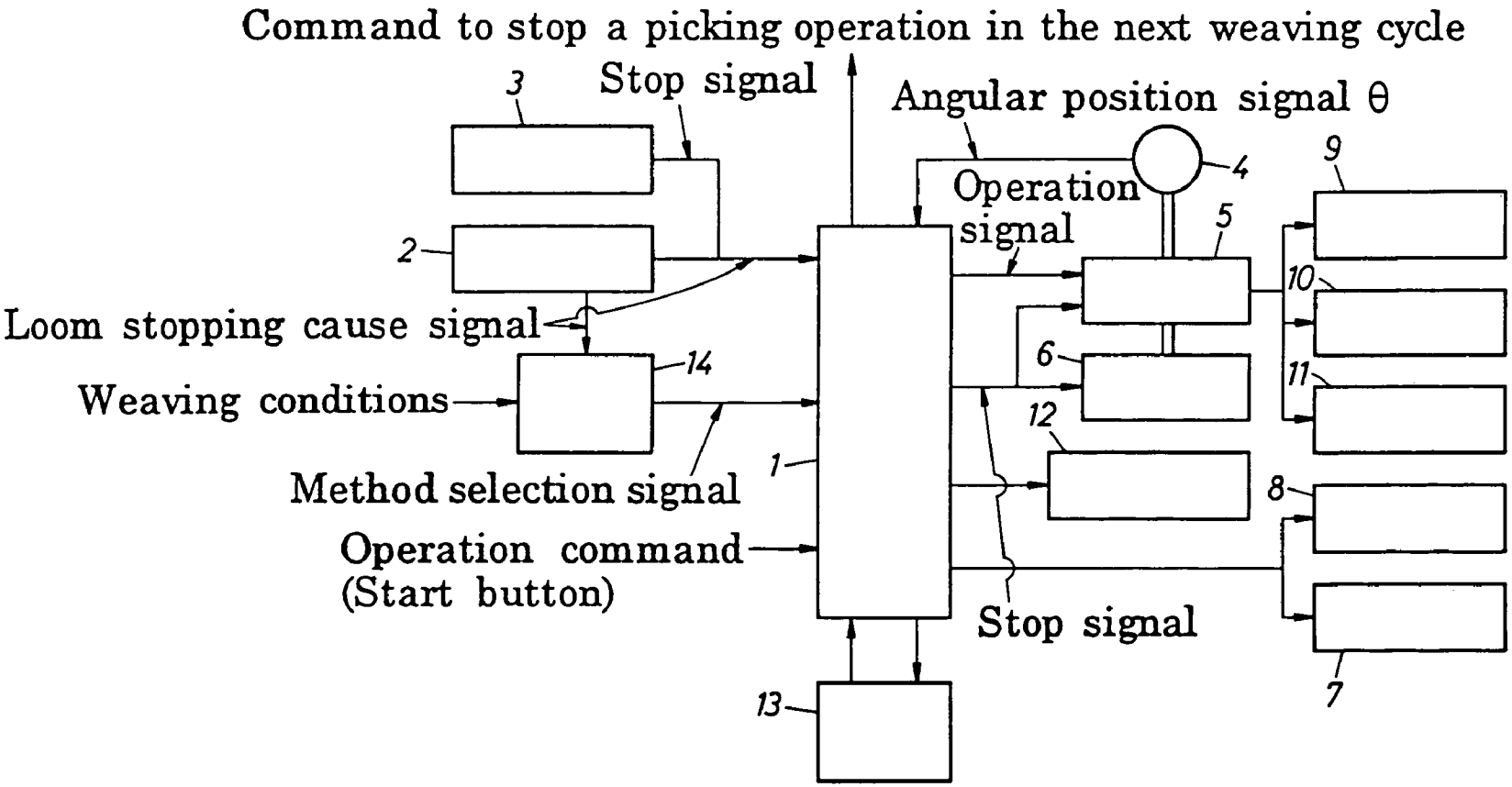
FIG. 9 is a block diagram of a control system for carrying out a loom restarting method according to the present invention.

FIG. 9 shows a control system for selectively carrying out the 60°-starting method and the one-shot-starting method. The control system shown in FIG. 9 is provided, in addition to components corresponding to those of the control system shown in FIG. 8, with a method selecting device 14 for selecting either the 60'-starting method or the one-shot-starting method. Upon the reception of the stop signal and the loom stopping cause detection signal, the method selecting device 14 selects either the 60°-starting method or the one-shot-starting method on the basis of information about weaving conditions given previously thereto, and gives a selection signal indicating the selection of either the 60'-starting method or the one-shot-starting method to the controller 1.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A loom restarting method comprising:

providing a loom stopping command upon the occurrence of a loom stopping cause entailing faulty picking in a loom;

withholding the loom from a picking operation during a braking period to stop the loom in a weaving cycle subsequent to a weaving cycle in which faulty picking occurred;

reversing the loom to the weaving cycle in which faulty picking occurred;

removing a weft yarn picked by faulty picking; and restarting the loom for a normal weaving operation, wherein a main shaft included in the loom is positioned, after removing the weft yarn picked by faulty picking, at an angular position at which a picking operation is possible in the weaving cycle where a normal weaving operation is performed in which the weft yarn picked by faulty picking was removed and the loom is reversed to an angular position at which a reed included in the loom is not in contact with a weft yarn inserted in the cloth fell of a fabric on the loom, and then the loom is restarted to perform the picking operation in the weaving cycle in which the weft yarn picked by faulty picking was removed.

2. A loom restarting method comprising:

providing a loom stopping command upon the occurrence of a loom stopping cause other than faulty picking in a loom;

withholding the loom from a picking operation during a braking period to stop the loom for an initial stop in a weaving cycle subsequent to a weaving cycle in which the loom stopping cause occurred;

removing the loom stopping cause; and restarting the loom for a normal weaving operation, wherein the main shaft of the loom is positioned at an angular position at which a picking operation is possible in the weaving cycle where a normal weaving operation is performed in which the loom was stopped for the initial stop and the loom is reversed to an angular position at which a reed included in the loom is not in contact with a weft yarn inserted in the cloth fell of a fabric on the loom, and then the loom is restarted to perform the picking operation corresponding to the initial stop in the weaving cycle.

3. A loom restarting method comprising:

providing a loom stopping command upon the occurrence of a loom stopping cause in a loom;

withholding the loom from a picking operation during a braking period to stop the loom for an initial stop in a weaving cycle subsequent to a weaving cycle in which the loom stopping cause occurred;

removing the loom stopping cause; and restarting the loom for a normal weaving operation, wherein a decision is made as to whether or not the loom stopping cause entailed faulty picking before the loom is stopped for the initial stop, and the loom is reversed to a weaving cycle in which faulty picking occurred, a weft yarn picked by faulty picking is removed, and a main shaft included in the loom is positioned at an angular position at which a picking operation is possible in the weaving cycle where a normal weaving operation is performed in which faulty picking occurred and the loom is reversed to an angular position at which a reed included in the loom is not in contact with a weft yarn inserted in the cloth fell of a fabric on the loom, and then the loom is restarted if the loom stopping cause entails faulty picking to perform the picking operation in the weaving cycle in which faulty picking occurred, or the loom stopping cause is removed, the main shaft of the loom is positioned at an angular position at which a picking operation is possible in the weaving cycle where a normal weaving operation is performed in which the loom is stopped for the initial stop and the loom is reversed to an angular position at which the reed of the loom is not in contact with a weft yarn inserted in the cloth fell of the fabric on the loom, and then the loom is restarted if the loom stopping cause does not entail faulty picking to perform the picking operation corresponding to the initial stop in the weaving cycle.

4. A loom restarting method comprising:

providing a loom stopping command upon the occurrence of a loom stopping cause in a loom;

withholding the loom from a picking operation during a braking period to stop the loom for an initial stop in a weaving cycle subsequent to a weaving cycle in which the loom stopping cause occurred;

removing the loom stopping cause; and restarting the loom for a normal weaving operation, wherein a decision is made as to whether or not the loom stopping cause entails faulty picking before the loom is stopped for the initial stop; and the loom is restarted either after reversing the loom to a weaving cycle in which faulty picking occurred, removing a weft yarn picked by faulty picking, and carrying out a one-shot picking operation, or after removing the weft yarn picked by faulty picking, and positioning a main shaft included in the loom at an angular position at which a picking operation is possible in the weaving cycle where a normal weaving operation is performed in which faulty picking occurred and the loom is reversed to an angular position at which the reed of the loom is not in contact with a weft yarn inserted in the cloth fell of a fabric on the loom, depending on weaving conditions if the loom stopping cause entails faulty picking to perform the picking operation in the weaving cycle in which faulty picking occurred, or the loom is restarted after removing the loom stopping cause, and positioning the main shaft of the loom at an angular position at which a picking operation is possible in the weaving cycle where a normal weaving operation is performed in which the loom was stopped for the initial stop and the loom is reversed to an angular position at which the reed of the loom is not in contact with a weft yarn inserted in the cloth fell of the fabric on the loom if the loom stopping cause does not entail faulty picking to perform the picking operation corresponding to the initial stop in the weaving cycle.

* * * * *